United States Patent [19]

Shimada

[11] 4,212,181

[45] Jul. 15, 1980

[54] MECHANISM FOR AUTOMATICALLY CENTERING SUB-GUIDE ROLLERS AND FOR ADJUSTING CLAMPING CONDITION OF SUB-GUIDE ROLLERS, FOR USE IN MATERIAL GUIDING APPARATUS OF ROLLING MILL

[75] Inventor: Hiroaki Shimada, Sappora, Japan

[73] Assignee: Kotobuki Sangyo Kabushiki Kaisha, Sapporo, Japan

[21] Appl. No.: 1,888

[22] Filed: Jan. 8, 1979

[51] Int. Cl.[2] ..... B21B 39/16

[52] U.S. Cl. ..... 72/250

[58] Field of Search ..... 72/250, 227

[56] References Cited

U.S. PATENT DOCUMENTS 3,348,403 10/1967 Bartley ..... 72/237

FOREIGN PATENT DOCUMENTS 1137705 2/1960 Fed. Rep. of Germany ..... 72/250

*Primary Examiner*—Milton S. Mehr

*Attorney, Agent, or Firm*—Oldham, Oldham, Hudak & Weber

[57] ABSTRACT

A mechanism for automatically centering sub-guide rollers and adjusting the clearance between the sub-guide rollers thereby to adjust the clamping condition of the material to be rolled, for use in the material guiding apparatus of a rolling mill for rolling a steel blank into wires, bars and so forth, the material guiding apparatus being of a type having a pair of roller holders 2, 3 each of which carrying corresponding one of a pair of main guide rollers 4, 5 and a pair of sub-guide rollers 41, 51. Each of the sub-guide rollers is rotatably carried by corresponding one of a pair of eccentric shafts pins 26 unitary with each of a pair of support shafts 25 supported by a corresponding roller holder. A right hand screw gear 27 and a left hand screw gear 28 are attached to respective ones of the support shafts 25. A manually operable right hand screw worm 29 and a right hand screw worm 30 which is also manually operable are made to engage with the gears 27, 28, respectively. The worms are carried by respective shafts 13, 14 which are brought into engagement for unitary rotation with each other as necessitated.

2 Claims, 6 Drawing Figures

MECHANISM FOR AUTOMATICALLY CENTERING SUB-GUIDE ROLLERS AND FOR ADJUSTING CLAMPING CONDITION OF SUB-GUIDE ROLLERS, FOR USE IN MATERIAL GUIDING APPARATUS OF ROLLING MILL

BACKGROUND OF THE INVENTION

1. Field of the Invention

In rolling mill having a plurality of series-arranged rolling stands for rolling metallic blank material into wires, strips, bars and so forth, it is necessary to smoothly introduce and guide the material to the central mold portion of the roll. For this purpose, there are provided a guiding roller apparatus at the inlet side of the roll. One of the typical guiding roller device has a pair of main guide rollers and a pair of sub-guide rollers. In such a guiding roller device, it is necessary to adjust the clamping or compressing condition of the sub-guide rollers, in accordance with the clamping or compressing condition of the main rollers, when the compressing or squeezing condition of the main guide rollers is changed and adjusted.

The invention relates to an improvement in the pair of sub-guide rollers.

2. Description of the Prior Art

The basic concept of the technical field with which the invention is concerned will be described hereinunder. For the convenience's sake, a reference is made to FIGS. 1, 2 and 6. Referring to these Figures, the guiding roller apparatus for guiding a blank steel W to be rolled to the rolls R, R' of a roll stand has a pair of roller holders 2, 3 which are pivoted by pins 6, 7 so as to be swung around these pins such that they converge at points upstream or downstream from the pins as viewed in the direction of the material flow. These pair of roller holders 2, 3 have pairs of guide rollers such as a pair of main rollers 4, 5 and a pair of sub-rollers 41, 51. The guide rollers of each pair cooperate with each other to clamp the material W therebetween. The clamping force, the roller clearance and other conditions have to be adjusted to provide an effective and reasonable clamping and guiding, so as to satisfy various requirements such as prevention of falling down of the blank material, linear guiding of the blank material and so on.

Referring to FIG. 6, the relation between the main rollers 4, 5 and the sub-rollers 41, 51 in the conventional apparatus is such that, when the distance between the peripheral surfaces of the main rollers 4, 5 contacting the material W is l, the roller holders 2,3 swingable around the pin 6, 7 to converge at points upstream or down stream from the pins is swung as illustrated to converge at the opposite side of the rollers to the pins 6, 7, forming therebetween an angle $\theta$. In this state, the distance l' between the peripheral surfaces of the sub-rollers is so large that the sub-rollers cannot make a contact with the material W. Consequently, the contact of the guide rollers is made uneven, and the satisfactory clamping by the plurality of pairs of the guide rollers cannot be performed.

Therefore, in the conventional rolling mill, means are mounted on respective sides of the roller holders, for independently adjusting the sub-rollers 41, 51. In such a rolling mill, it is necessary to adjust the roller clearance l' of the sub-rollers, at each time the clamping condition of the main rollers is changed, so that the clamping conditions of these rollers may correspond to each other. Such adjustment, however, requires a high degree of technique. At the same time, the overall breadth of the rolling mill is inconveniently increased due to the presence of the means for adjusting the sub-rollers 41, 51.

SUMMARY OF THE INVENTION

It is therefore a major object of the invention to provide a mechanism which affords an even contact of the plurality of pairs of guide rollers with the blank material to be rolled, as well as an optional centering of these rollers for optimized clamping condition, in the rolling mill for rolling a material such as steel into, for example, steel wires, steel bars, steel strips and so on.

It is another object of the invention to provide a mechanism in which the sub-rollers are mounted on respective roller holders by means of eccentric shafts the rotation of which is controlled by a single touch of hand, so as to change the roller clearance of the sub-rollers, so that the sub-guide rollers are automatically centered with respect to the main guide rollers, thereby to ensure a complete and safe clamping of the material processed.

More specifically, referring to FIG. 6, the sub-rollers 41, 51 are swung to and from the guiding axis of the blank material steel W, simultaneously, so that the roller clearance of the sub-rollers is changed from l' to l by a single action.

The invention will be more fully understood from the following description of the preferred embodiment taken in conjunction with the accompanying drawings.

DESCRIPTION OF THE PREFERRED EMBODIMENTS

Figure 1:
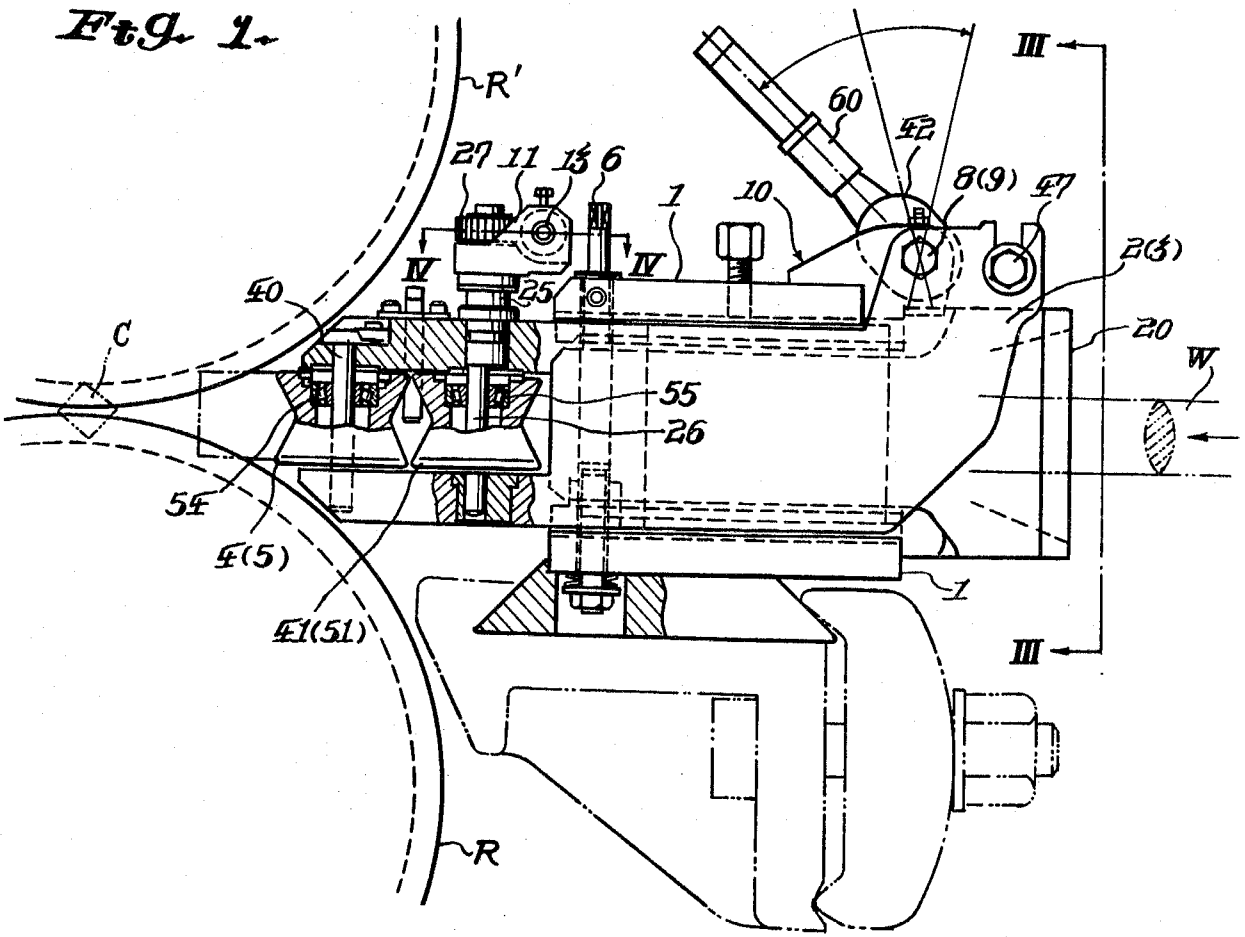
FIG. 1 is a side elevational view of a material guiding apparatus of a rolling mill, equipped with a mechanism embodying the invention for automatically adjusting the centering of the sub-guide roller.
Figure 2:
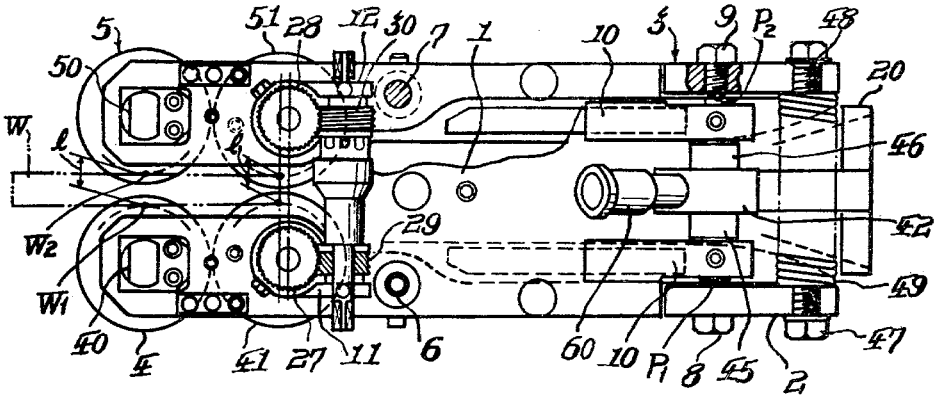
FIG. 2 is a plan view of the apparatus as shown in FIG. 1.
Figure 3:
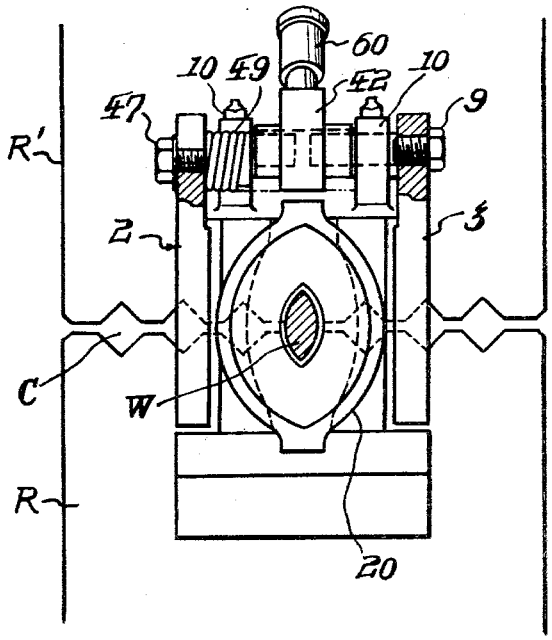
FIG. 3 is a back-side elevational view of the apparatus as shown in FIG. 1.

Referring to FIGS. 1 and 2, a pair of roller holders 2, 3 are installed in a symmetric manner from the outside of a guide box 1. These roller holders 2, 3 rotatably carry at their front portions respective one of a pair of main guide rollers 4, 5 and respective one of sub-guide rollers 41, 51. The roller holders 2, 3 are swingably supported by the guide box 1 through pivot pins 6, 7. An entry guide 20 provided at the center of the guide box 1 is adapted to make a preliminary guide of the steel material W to be rolled down to the positions of the main guide rollers 4, 5 and sub-guide rollers 41, 51. The material W is clamped by the main guide rollers 4, 5 and guided to the center of the mold groove C on the peripheral surface of the rolls R, R' (See FIGS. 1, 3). The clamping force is adjusted by moving the loading points W1, W2 (See FIG. 2) toward and away from each other. The sub-guide rollers 41, 51 have therein roller bearings 55, and are carried rotatably by eccentric shaft pins 26 which are unitary with vertical support shafts 25 adjustably and rotatably mounted on respective roller holders 2, 3.

Figure 4:
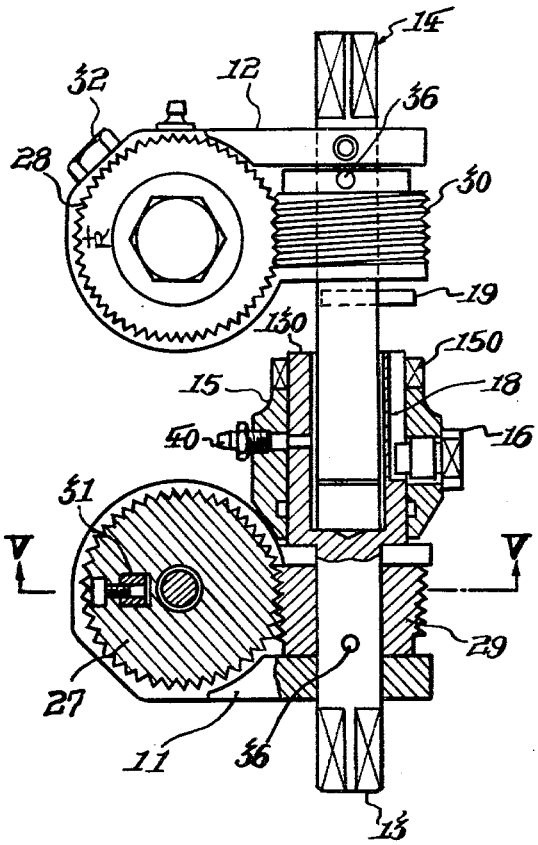
FIG. 4 is a sectional view of essential parts of the mechanism of the invention, taken along the line IV—IV of FIG. 5.
Figure 5:
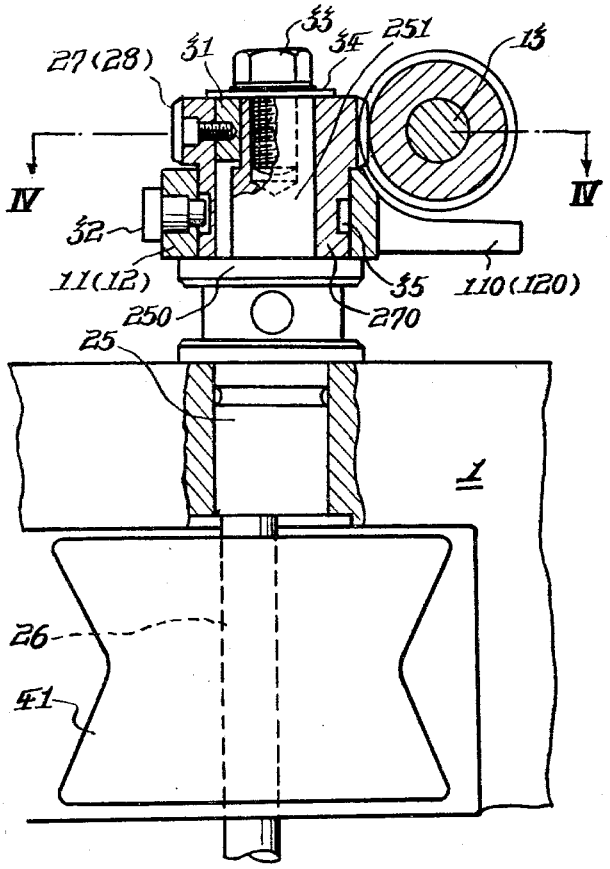
FIG. 5 is a sectional view taken along the line V—V of FIG. 4.
Figure 6:
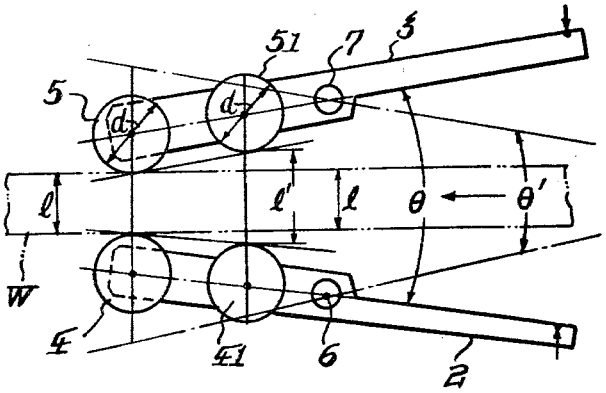
FIG. 6 is a figure explaining the function of a material guiding apparatus of a rolling mill conventionally used.

As shown in FIGS. 4 and 5, each of the support shafts 25 has at its upper portion a flange portion 250 and a portion 251 of reduced diameter. The boss or hub of a left hand screw gear 27 (or right hand screw gear) is secured to the portion 251 of reduced diameter by means of a key 31, and is fixed by a fixing screw 33, for a unitary rotation with the vertical support shaft 25. The screw gear 27 (28) has an extended boss 270 which rotatably fits a gear frame 11 (12) which is in contact with the upper surface of the flange portion 250. The left and right hand screw gears 27, 28 are prevented from moving axially, by key bolts 32 which are driven through the gear frames 11 (12) to project into a circumferential key groove 35 of the extended boss 270.

The first gear frame 11 is attached to the first roller holder 2, while the second gear frame 12 is attached to the second roller holder 3. As shown in FIG. 4, both gear frames 11, 12 are disposed along a same line. A spindle 13 and a shaft 14 are adapted to be engaged by and disengaged from each other by means of a dog clutch 15. The spindle 13 and the shaft 14 carry, respectively, a left hand screw pinion (worm) 29 and a right hand screw pinion (worm) 30, respectively. These pinions are fixed by means of spring-equipped pins 36, 36. The left hand screw pinion 29 and the right hand screw pinion 30 engage the left hand screw gear 11 and the right hand screw gear 28, respectively.

The inner end of the spindle 13 is formed into a tube 130 adapted for slidably receiving the inner end of the shaft 140. The outer peripheral surface has a key groove extending along the length of the spindle 13 adapted to slidably receive the end of a key bolt 16 which is screwed into the dog clutch 15, thereby to prevent the relative rotation. The engagement of the key bolt 16 and the key groove 18 on the other hand allows the longitudinal sliding of the dog clutch 15. By axially sliding the dog clutch, a dog pin 19 formed on the shaft 14 comes into engagement with one of a plurality of retaining recess 150 formed in the end of the dog clutch 15, so that the spindle 13 and the shaft 14 are made rotatable together with each other. The outer ends of the spindle 13 and the shaft 14 is formed to have a polygonal cross-section, so as to be engageable by a wrench, handle or the like. In FIG. 4, a reference numeral 40 denotes a grease nipple for the lubrication of the sliding parts.

Hereinafter, the automatic centering swinging operation of the sub-guide rollers 41, 45 having the described construction will be described.

As shown in FIGS. 1 and 5, the eccentric shaft pins 26 of the vertical support shafts 25 of respective roller holders 2, 3 have required eccentricities. These eccentricities is utilized in adjusting the roller clearance l′ of the sub-guide rollers 41, 51. The eccentric positions of the eccentric shaft pins 26 are indicated on the scales provided on the upper surfaces of the left hand screw gear 27 and the right screw gear 28, as at "R" on the gear 28 (See FIG. 4).

After setting the eccentricities of respective gears 27, 28 in symmetry, the dog pin 19 of the dog clutch 15 is brought into engagement with one of the retaining recesses, so that they may rotate unitarily with each other. Then, a wrench or a handle are attached to the polygonal head of the shaft 14 or the spindle 13. As the spindle 13 or the shaft 14 is rotated, the combination of the left hand screw pinion 29 and the associated left hand screw gear 27 and the combination of the right hand screw pinion 30 and the associated right hand screw gear 28 are rotated in the opposite directions. In the illustrated embodiment, as the spindle 13 (shaft 14) is rotated clockwise as viewed on FIGS. 1 and 4, the left hand screw gear 27 is rotated counter-clockwise, while the right hand screw gear 28 rotate clockwise. The gears 27 and 28 have a same number of gear teeth.

Consequently, by a rotation of the pinion shaft (spindle 13 and shaft 14), the eccentric shaft pins 26 of the vertical support shafts 25 of first and second roller holders 2, 3 are rotated in the opposite directions, so that the sub-guide rollers 41, 51 carried by respective eccentric shaft pins 26 are swung at each side of the central axis of feed of the material W, to change and finely adjust the roller clearance l′ by a single action.

Consequently, it becomes possible to easily effect an adjustment of roller clearance to evenly clamp the material W fed to the roll stand, by both of the main guide rollers 4, 5 and the sub-guide rollers 41, 51.

In the illustrated embodiment, only one pair of sub-guide rollers are used. However, needless to say, the invention can equally be applied to the apparatus having two or more pairs of sub-guide rollers 41, 51.

In FIGS. 1 and 2, reference numerals 8, 9 denote a pair of pivot shafts screwed into the first and the second roller holders in opposite directions. The ends of the pivot shafts are supported horizontally by the extension 10, 10 of the guide box, and contacts both short axis ends axially movable in supporting sleeves 45, 46, so as to constitute the points P1, P2 of force by which the roller holders 2, 3 are born by the pivot points 6, 7.

A reference numeral 60 denotes a handle which is rockable back and forth (to the right and left in FIG. 1). By reciprocatorily rotating a sleeve 42 unitary with the handle, the points P1, P2 of force are adjusted inwardly and outwardly by a suitable mechanism not shown.

A coiled tension spring 49 stretched between the rear ends of the roller holders 2, 3 are retained by the roller holders by means of bolts 47, 48 screwed into both ends thereof, and is adapted to bias the roller holders 2, 3 such that the opposing surfaces of the rear ends of these roller holders 2, 3 are always pressed against respective points P1, P2 of force.

What is claimed is:

1. An automatic centering and clamping adjusting mechanism for adjusting the clearance between a pair of sub-guide rollers by swinging each of said rollers at each side of the axis of feed of the material to be rolled, for use in a material guiding apparatus of a rolling mill, characterized by comprising the following features A, B, C, D and E:

(A) first and second roller holders 2,3 adapted to be swung around respective pivot points 6,7, said roller holders 2,3 carrying at their front portions guide rollers 4,5 and having support shafts 25 rotatably attached thereto;

(B) sub-guide rollers 41,51 rotatably carried by respective eccentric shaft pins 26 which are unitary with respective support shafts 25;

(C) a left hand screw gear 27 fixed to one end of said support shaft 25 on said first roller holder 2, and a right hand screw gear 28 fixed to one end of said support shaft 25 on said second roller holder 3;

(D) a left hand screw pinion 29 and a right hand screw pinion 30 which can be rotated coaxially by manual operation and engaging respectively one of said left hand screw gear 27 and said right hand screw gear 28, and (E) manually rotatable shafts 13,14 carrying said left hand screw pinion 29 and right hand screw pinion 30 of feature (D) above are axially aligned with each other, and wherein a dog clutch adapted to allow only sliding movement is attached to one of said shafts, while a dog pin 19 for engagement with said dog clutch is attached to the other shaft, whereby said left hand screw pinion 29 and said right hand screw pinion 30 can be rotated simultaneously when said dog pin and dog clutch are engaged.

2. An automatic centering and clamping adjusting mechanism for adjusting the clearance between a pair of sub-guide rollers by swinging each of said rollers at each side of the axis of feed of the material to be rolled, for use in a material guiding apparatus of a rolling mill, characterized by comprising a guide frame positioning:

(A) first and second roller holders 2,3 adapted to be swung around respective pivot points 6,7, said roller holders 2,3 individually carrying at their front portions one of a pair of guide rollers 4,5 and having support shafts 25 rotatably attached thereto;

(B) sub-guide rollers 41,51 individually rotatably carried by respective eccentric shaft pins 26 which are unitary with respective support shafts 25;

(C) a left hand screw gear 27 fixed to one end of said support shafts 25 on said first roller holder 2, and a right hand screw gear 28 fixed to one end of said support shaft 25 on said second roller holder 3;

(D) a left hand screw pinion 29 and a right hand screw pinion 30 positioned on a common axis and engaging respectively one of said left hand screw gear 27 and said right hand screw gear 28;

(E) independently rotatable shafts 13,14, one carrying said left hand screw pinion 29 and the other right hand screw pinion 30 and axially aligned with each other, and (F) clutch means operably connecting said shafts 13,14 whereby said left hand screw pinion 29 and said right hand screw pinion 30 can be rotated simultaneously by coupling said shafts 13,14 together and rotating one of such shafts for adjusting the pair of sub-guide rollers 41,51 simultaneously.

* * * * *